United States Patent [19]

Clayson et al.

[11] 4,209,956

[45] Jul. 1, 1980

[54] FORMING OVERLAPPED WRAPPERS

[75] Inventors: Arthur J. Clayson; Austin L. Fox, both of London, England

[73] Assignee: Molins Limited, London, England

[21] Appl. No.: 915,092

[22] Filed: Jun. 13, 1978

[30] Foreign Application Priority Data

Jun. 21, 1977 [GB] United Kingdom ..... 25974/77

[51] Int. Cl.[2] ..... B65B 41/16

[52] U.S. Cl. ..... 53/396; 53/389; 83/88

[58] Field of Search ..... 53/396, 466, 228, 389; 271/182, 202; 83/88, 110, 404

[56] References Cited

U.S. PATENT DOCUMENTS

| | | | |
|---|---|---|---|
| 2,107,482 | 2/1938 | Kemp | 53/389 X |
| 2,670,955 | 3/1954 | Strecker | 271/202 |
| 3,274,870 | 9/1966 | Schmermund | 53/389 X |
| 3,367,221 | 2/1968 | Schmermund | 53/389 X |
| 3,911,800 | 10/1975 | Feldkamper | 271/182 X |
| 3,942,786 | 3/1976 | Lauren | 271/202 X |
| 3,982,375 | 9/1976 | Focke | 53/389 X |

*Primary Examiner*—John Sipos

*Attorney, Agent, or Firm*—John C. Smith, Jr.

[57] ABSTRACT

Overlapped foil wrappers are formed by feeding a foil web (1 or 21) at uniform speed from an upper pair of rollers (2 or 22) to a lower pair of rollers (5,6 or 25,26) rotating at a uniform slower speed. A first cutter (3,4 or 23,24) between the upper and lower rollers cuts the web at intervals of the overall length of a wrapper, and such that an overlap is formed by the time the newly cut leading end of the web is engaged by the lower rollers. A second cutter below the lower rollers cuts the web downstream of the overlap to form the short wrapper piece (loose front foil). The lower roller (6) may move away from the other roller (5) while the overlap is forming, allowing the distance between upper and lower rollers to be reduced.

13 Claims, 8 Drawing Figures

FORMING OVERLAPPED WRAPPERS

Figures 1A, 1B, 1C, 1D:
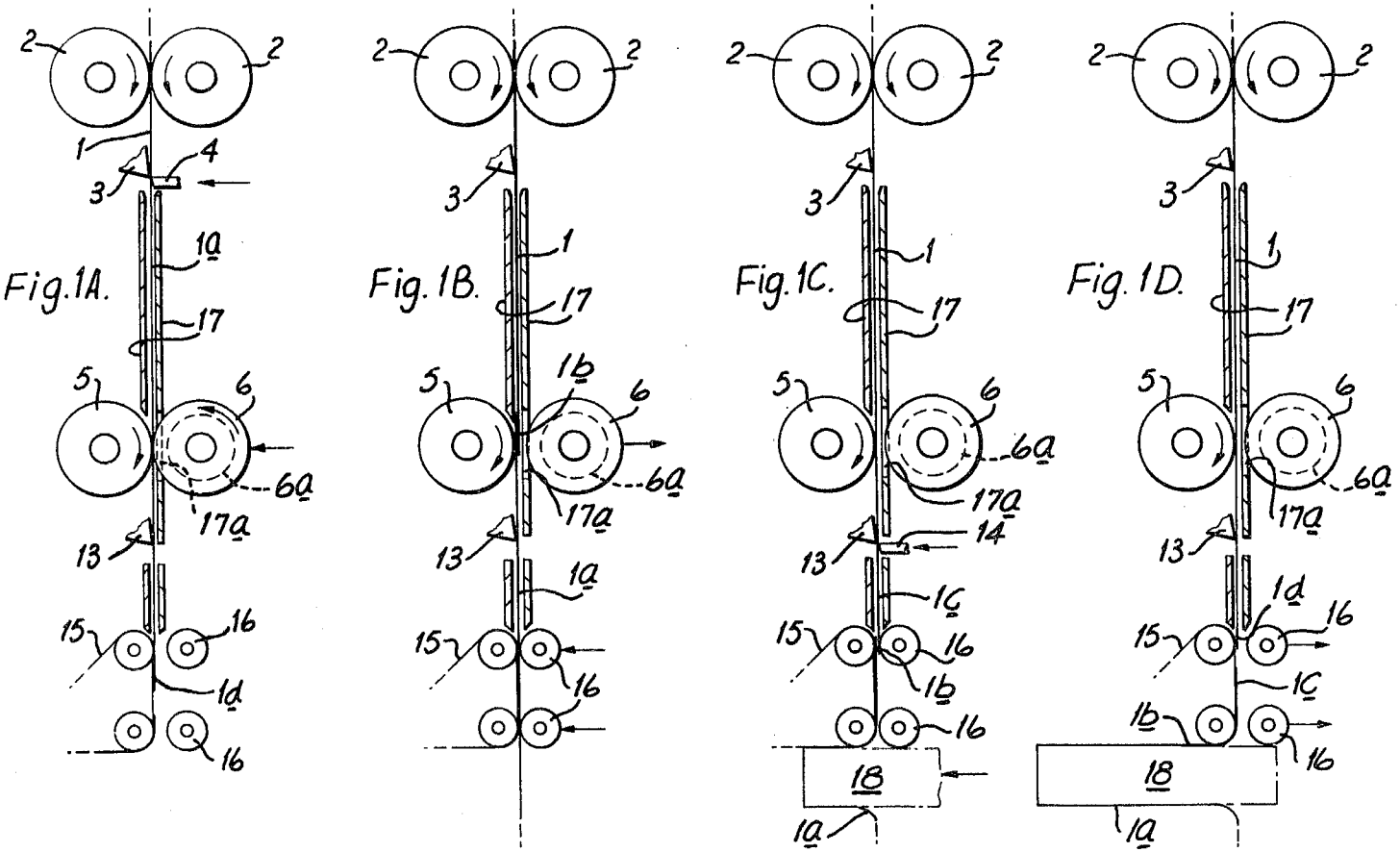

This invention concerns improvements in or relating to the forming of pairs of overlapped wrappers, for example aluminium foil wrappers for wrapping articles such as groups of cigarettes.

One common method of forming pairs of overlapped wrappers for wrapping groups of cigarettes is to feed a web of wrapping material at a cyclically varying speed past a twin cutter; the arrangement is such that when one wrapper piece has been cut, the web is accelerated to overtake the first piece and thus produce an overlap therewith before the web is again cut to form the second piece of the pair. Such an arrangement may become unsatisfactory at higher speed, due to the high accelerational forces resulting from the cyclic speed.

It has been proposed, for example in U.S. Pat. No. 3,367,221, to feed the web at a uniform speed and to produce an overlap between cut pairs of wrapper pieces by subjecting alternate pieces momentarily to suction. However such an arrangement may not always work satisfactorily as the suction ports, whose timing is critical, can easily become clogged with dirt, thus affecting the amount of overlapping.

According to this invention we provide a method of forming pairs of overlapped wrappers for wrapping articles such as groups of cigarettes, comprising the steps of feeding a web of wrapping material at a feed speed towards a conveyor movable at a first speed, said feed speed being higher than said first speed, cutting the web upstream of the conveyor at intervals corresponding to the sum of the lengths of the individual wrappers of a pair, so that the newly cut end of the web overtakes the trailing end of the cut piece and forms an overlap therewith, and making a further cut downstream of the conveyor at a desired position behind said overlap to form a pair of overlapped wrappers.

Further according to this invention we provide apparatus for forming pairs of overlapped wrappers for wrapping articles such as groups of cigarettes, comprising: a first conveyor movable at a first speed and engageable with a web of wrapping material; a second conveyor for feeding the web on to the first conveyor at a higher speed than said first speed; a first cutter positioned between said first and second conveyors for cutting the web at intervals corresponding to the sum of the lengths of the individual wrappers of a pair, the arrangement being such that as the first cutter operates the web is engaged by the first conveyor so that the newly cut end of the web overtakes the trailing end of the cut piece and forms an overlap therewith; and a second cutter downstream of the first conveyor for cutting the web at a desired position behind each overlap to form a pair of overlapped wrappers.

The cutters may be either rotary drum cutters, or fly cutters (i.e. cutters whose axes of rotation are parallel to the direction of movement of the web).

Preferably the web is fed vertically downwards between opposed guide walls.

The amount of overlap produced at the first conveyor may be greater than that which is finally required; and for this purpose a third conveyor may be provided downstream of said second cutter at a distance therefrom shorter than the length of the short wrapper of a pair (where the wrappers of a pair are of unequal length), the speed of said third conveyor being higher than the speed of said second conveyor which feeds the web, so that said overlap is reduced accordingly.

The first conveyor may be permanently engageable with the web, being positioned downstream of the first cutter by a distance shorter than the sum of the lengths of the individual wrappers of a pair. The third conveyor may likewise be permanently engageable with the web, the spacing between said first and third conveyors being shorter than the length of the long wrapper of a pair of unequal length.

Alternatively the third conveyor, or both the first and third conveyors, may only be engageable with the web intermittently. This permits the distances between respective adjacent conveyors to be appreciably reduced. In this case the first and/or third conveyors may be opposed pairs of conveyors (e.g. rollers), one conveyor of each pair being movable relative to the other conveyor of the pair which is preferably fixed and driven.

Figure 2:
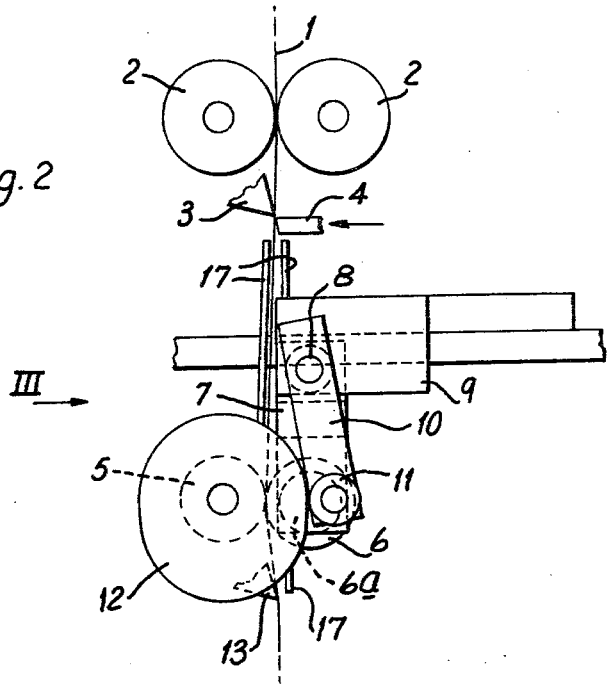
Figure 3:
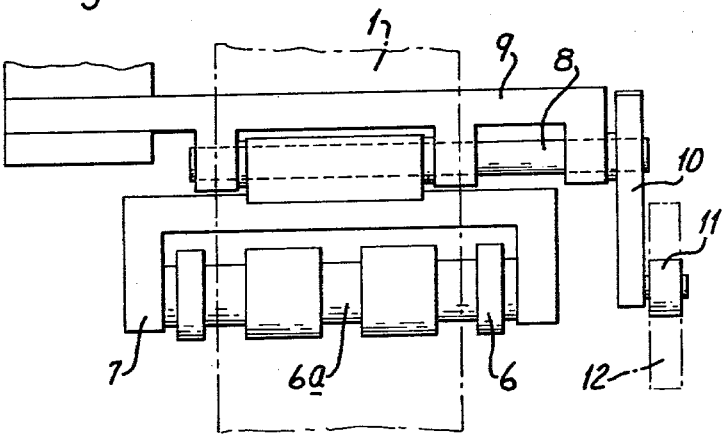
Figure 4:
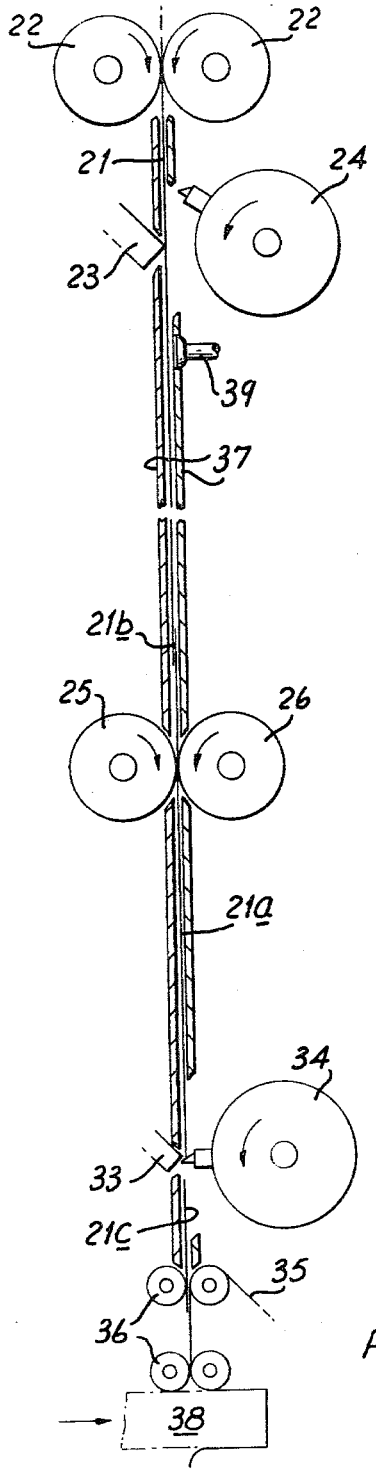
Figure 5:
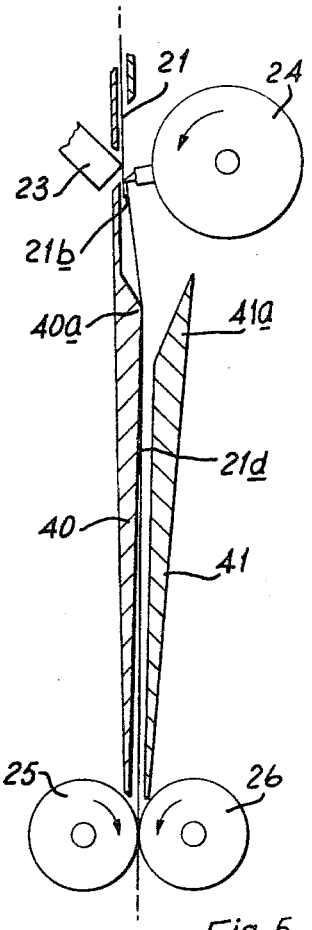

Two embodiments of the invention will now be described, by way of example only, with reference to the accompanying drawings, in which:

FIGS. 1A to 1D show the sequence of operations of apparatus according to the first embodiment, FIG. 2 is a side view similar to a part of FIG. 1A, showing further details of the apparatus, FIG. 3 is an end view of part of the apparatus of FIG. 2, as seen in the direction of arrow III thereof, FIG. 4 is a side view of the second embodiment, and FIG. 5 shows a modification of FIG. 4.

Referring first to FIGS. 2 and 3, there is shown a wrapper web 1 of aluminium foil being fed downwardly by a pair of upper feed rollers 2 (FIG. 2). The web is fed past a ledger 3 of a fly cutter against which, at the position shown in FIG. 2, a cooperating knife 4 is about to sever the web. The knife 4, shown diagrammatically, is in fact in the shape of a thin blade rotating about a vertical axis.

Beneath the fly cutter 3, 4 the web passes between a further pair of rollers 5, 6 of which the roller 5 is fixed and driven, the speed of the roller 5 being less than that of the feed rollers 2. The roller 6 is rotatably mounted at the forked end of a lever 7 whose other end is secured to a pin 8 pivotally mounted on fixed structure 9. Also secured to the pin 8 is an arm 10 carrying a cam follower roller 11 which is spring biassed against a cam 12. When the lift portion of the cam 12 meets the roller 11, the pin 8 is caused to rotate, bringing the roller 6 out of contact with the driven roller 5.

Referring now also to FIGS. 1A to 1D, beneath the rollers 5, 6 is a further fly cutter 13, 14 (FIG. 1C) similar to the cutter 3, 4. The web 1 then meets a driven conveyor band 15 against which two idle rollers 16 are engageable. The speed of the band 15 is higher than that of the rollers 2, typical relative speeds being indicated below.

Extending between the cutter 3, 4 and the band 15 at each side of the web 1 are fixed pairs of guide walls 17. The roller 6 is formed with three grooves **6*a* (FIG. 3), in the vicinity of which the right-hand guide wall 17 consists of three narrow strips 17*a* (FIG. 1A) each of a width slightly smaller than the width of a groove, so that with the roller 6 in contact with the driven roller 5 each strip 17*a* extends through a corresponding groove 6*a*. When the roller 6 is moved away from the driven roller 5 it gradually comes to rest, and the strips 17*a* then prevent the web 1** touching the resulting stationary periphery of the roller and thus being slowed down thereby.

The mechanism for moving the rollers 16 into and out of engagement with the band 15 is not shown, but may be similar to the mechanism for moving the roller 6, shown in FIGS. 2 and 3.

The manner in which a pair of overlapped wrappers is formed for wrapping around a bundle of cigarettes 18 (FIGS. 1C and 1D), will now be described with reference particularly to FIGS. 1A to 1D.

Commencing with the apparatus in the position shown in FIG. 1A, the leading end of the web 1 has reached the band 15, with the rollers 16 in the open position, and the roller 6 has just been moved by the cam 12 into contact with the driven roller 5. At this instant the knife 4 severs the web, sweeping the trailing end of the resulting cut piece 1*a* towards the left against the left-hand one of the pair of guide walls 17. Due to the reduced speed at which the piece 1*a* is moved downwards by the rollers 5, 6, the newly cut end of the web starts to overtake the trailing end of the piece 1*a* to the right thereof, to form an overlap 1*b* (FIG. 1B) with said trailing end.

As the overlap 1*b* reaches the rollers 5, 6, the rollers 16 are moved towards the band 15 to grip the piece 1*a*, and immediately afterwards the roller 6 is moved away from the roller 5, as shown in FIG. 1B. The speed at which the cut piece 1*a* is fed by the band 15 and rollers 16 is greater than the speed at which the web is fed by the rollers 2, so that the amount of overlap begins to decrease as the overlap 1*b* passes from the rollers 5, 6 to the band 15 and rollers 16.

Before the overlap 1*b* reaches the band 15, a bundle of cigarettes 18 is conveyed towards the left across the path of the wrapper piece 1*a*, and thus becomes wrapped in the piece 1*a*, as shown in FIG. 1C. The fly cutter 13, 14 now operates to sever a short piece 1*c* from the foil web, thus forming the desired pair of overlapped wrapper pieces 1*a*, 1*c*. (The short piece 1*c*, sometimes referred to as the "loose front foil", is the part of the inner wrapper which in the final cigarette package is discarded by the consumer to facilitate the removal of cigarettes from the package.)

As the new leading end of 1*d* of the web reaches the band 15, the rollers 16 move apart, as shown in FIG. 1D, so that the web will not be stretched by the difference in speed between the band 15 and the upper rollers 2. The wrapper pieces 1*a*, 1*c* then continue to be wrapped around the bundle 18, while the end 1*d* of the web moves further downwards to the position shown in FIG. 1A, where the cycle of operations is repeated as above described.

By way of example, for a pair of wrappers of which the short piece has a length of 46 mm and the long piece a length of 180 mm, typical relative feed speeds of the rollers 2 and 5, and of the band 15 may be as follows, for each cycle of operations:

Rollers 2—226 mm/cycle
Roller 5—194 mm/cycle
Band 15—254 mm/cycle

In this example the overlap 1*b* is reduced from a maximum of about 17 mm at the rollers 5, 6, to about 6 mm at the band 15; and the effective distance between the fly cutter 13, 14 and the band 15 is about 43 mm, i.e. 3 mm less than the length of the short piece 1*c*.

Referring now to the apparatus according to the second embodiment, shown in FIG. 4, there is again shown an upper pair of fixed rollers 22 for feeding a web 21 of wrapping material, downwards. Immediately below the rollers 22 is a rotary cutter, comprising a cutting drum 24 which operates against a fixed cutting blade 23. Clearly, however, a fly cutter as described above could be used in place of the rotary cutter.

Spaced from the cutter 23, 24 by a distance of about 3 mm less than the sum of the lengths of the individual pieces of the desired pair of wrappers, are a further pair of rollers 25, 26 which are fixedly mounted so that they are in continuous contact with wrapper pieces severed successively from the web 21 by the cutter 23, 24. The rollers 25, 26 are driven at a slightly lower peripheral speed than the rollers 22.

Below the rollers 25, 26 is a second rotary cutter 33, 34, similar to the cutter 23, 24; and below the cutter 33, 34 is a conveyor band 35 and rollers 36, similar to the band 15 and rollers 16 of the first embodiment, except that the rollers 36 are fixed, so that they are in continuous contact with the wrapper pieces.

The speed of the band 35 is slightly higher than that of the rollers 25, 26; and the effective distance therebetween is 3 mm less than the length of the long wrapper piece 21*a*. As in the first embodiment, the effective distance between the band 35 and the cutter 33, 34 is again 3 mm less than the length of the short wrapper piece 21*c*.

Pairs of guide walls 37 extend along the full lengths between the cutters 23, 24 and 33, 34 and the rollers 22, 25, 26 to constrain the web 21 along a vertically downward path. Mounted in the right-hand guide wall 37 immediately below the cutting drum 24 is a suction port 39.

The operation of the apparatus is in some respects similar to that of the first embodiment, as follows:

As the leading end of the web 21 enters the nip between the rollers 25, 26 the cutting drum 24 severs a length of web corresponding to the total length of a pair of wrappers. The peripheral speed of the cutting drum 24 is slightly greater than the web speed, so that as its cutting edge severs the web, it remains attached momentarily to the trailing end of the severed length. At this moment suction is applied briefly to the port 39 to urge the trailing end against the right-hand guide wall 37, thus allowing the newly cut end of the web to begin overtaking the trailing end to the left thereof, to form an overlap 21*b*.

At the position shown in FIG. 4 the second cutter 33, 34 has just severed a short wrapper piece 21*c* from the cut piece. This short piece becomes part of a pair of overlapped wrappers already being formed about a bundle of cigarettes 38, which is shown being conveyed towards the right. The remaining severed piece 21*a*, on the other hand, is the long wrapper piece of the next pair of wrappers.

As the overlap 21*b* passes out of the rollers 25, 26 the leading end of the long piece 21*a* meets the band 35. Due to the higher speed of the band relative to that of the rollers 25, 26, the amount of the overlap 21*b* begins to reduce, in the same manner as in FIGS. 1B and 1C of the first embodiment. On reaching the band 35 the desired amount of overlap is achieved, and the cutting drum 34 then severs the short piece 21*c* as previously described, to produce the overlapped wrapper pieces 21*a*, 21*c*.

In FIG. 5 is shown a modification of the apparatus of FIG. 4, which permits the suction port 39 to be dispensed with.

Between the cutters 23, 24 and the rollers 25, 26 are specially shaped guide walls 40 and 41. The left-hand wall 40 is provided with a projecting edge portion 40*a* which extends towards the path of the web 21. Opposite the edge portion 40*a* the top of the right-hand wall 41 has a relieved portion 41*a* inclined away from the wall 40. Below the portions 40*a* and 41*a* the width of the passage between the walls 40, 41 is constant, but the thickness of the walls 40, 41 reduces towards the rollers 25, 26.

In the position shown in FIG. 5 the cutting drum 24 is further advanced than in FIG. 4, having just severed the web 21. Due to the bend imparted to the severed length 21*d* (comprising the pieces 21*a* and 21*c*) by the projecting portion 40*a*, the trailing end of the length 21*d* tends to straighten out, moving to the right. But the leading end (i.e. the newly cut end) of the web carries on vertically downwards, so that an overlap 21*b* starts to form almost immediately after the web has been severed. On meeting the inclined part of the wall 40 upstream of the edge portion 40*a*, the leading end of the web 21 is deflected to the right, so that the overlap 21*b* which it forms with the length 21*d* is guided over the edge portion.

Thus by having shaped guide walls 40, 41, an overlap 21*b* can be produced reliably, and without the complication and critical timing problems of a suction port 39.

It will be apparent that while the arrangement of FIG. 4 is of a simpler construction than that of the first embodiment, it occupies a considerably great height. Furthermore, the cutters and/or rollers must be vertically adjustable to allow for variations in the length of wrapper pieces, whereas in the first embodiment such variations can, to a large extent, be accommodated by altering the timings of the movable rollers. However both the arrangements described allow overlapped pairs of wrappers to be accurately formed at high speed.

We claim:

1. A method of forming pairs of overlapped wrappers for wrapping articles such as groups of cigarettes, comprising the steps of feeding a web of wrapping material at a constant feed speed towards a conveyor movable at a first speed, said constant feed speed being higher than said first speed, cutting the web upstream of the conveyor at intervals corresponding to the length of the first wrapper of said pair, so that the newly cut end of the web overtakes the trailing end of the cut piece and forms an overlap therewith, and making a further cut in said web downstream of the conveyor at a desired position behind said overlap to cut a second wrapper of said pair to thereby form a pair of overlapped wrappers, said conveyor conveying said first wrapper only during the period between the cutting of the web upstream of the conveyor and the newly cut end of the web reaching said conveyor.

2. A method as claimed in claim 1 in which the step of making a further cut is preceded by feeding the cut piece onto a further conveyor moving at a speed higher than said feed speed so that said overlap is reduced accordingly.

3. Apparatus for forming pairs of overlapped wrappers for wrapping articles such as groups of cigarettes, comprising: a first conveyor for conveying and engaging the first wrapper of said pair of wrappers at a first constant speed; a second conveyor for feeding the web onto the first conveyor at a higher constant speed than said first speed; a first cutter positioned between said first and second conveyors for cutting the web at intervals corresponding to the length of the first wrapper of said pair, the arrangement being such that as the first cutter operates the first wrapper is engaged by the first conveyor so that the newly cut end of the web overtakes the trailing end of the cut piece and forms an overlap therewith; and a second cutter downstream of the first conveyor for cutting the web at a desired position behind each overlap to cut a second wrapper of said pair to thereby form a pair of overlapped wrappers, said first conveyor engaging said first wrapper only during the period between operation of said first cutter and said newly cut end of the web reaching said first conveyor.

4. Apparatus as claimed in claim 3 wherein said wrappers of each pair are of unequal length, said apparatus further comprising a third conveyor disposed downstream of said second cutter at a distance therefrom shorter than the length of the short wrapper of said pair, the speed of said third conveyor being higher than the speed of said second conveyor which feeds the web, so that said overlap is reduced accordingly.

5. Apparatus as claimed in claim 4 in which said third conveyor is intermittently engageable with said first wrapper.

6. Apparatus as claimed in claim 5 in which said first conveyor comprises an opposed pair of rollers, one roller of the pair being bodily movable relative to the other roller, said other roller being driven.

7. Apparatus as claimed in claim 3 in which said first and second cutters are rotary drum cutters.

8. Apparatus as claimed in claim 7 further comprising a pair of substantially vertical guide members disposed between said first drum cutter and said first conveyor and between which the web is fed, the guide member on the side of said web opposite said first drum cutter being provided with a projection to deflect said trailing end of the cut piece, thereby allowing said newly cut end of said web to overtake said trailing end of said cut piece on the side opposite said first drum cutter.

9. Apparatus for forming pairs of overlapped wrappers, each consisting of a short wrapper and a long wrapper, for wrapping articles such as groups of cigarettes, comprising:

(a) first conveying means intermittently engageable with said long wrapper and drivable at a first constant speed;

(b) second conveying means permanently engageable with said web, and drivable at a second constant speed higher than said first constant speed to feed said web towards said first conveying means;

(c) first rotary cutting means positioned between said first and second conveying means for cutting said web at intervals corresponding to the length of said long wrapper; and (d) second rotary cutting means downstream of said first conveying means for cutting said web to form each short wrapper of a pair;

(e) said first conveying means conveying and engaging said cut long wrappers only during a period between operation of said first cutting means and the arrival of a newly cut end of said web at said first conveying means so that during said period said newly cut end overtakes and comes into overlapping relationship with the long wrapper cut by said first cutting means.

10. Apparatus for forming pairs of overlapped wrappers for wrapping articles such as groups of cigarettes, comprising:

(a) first conveying means for conveying and engaging the first wrapper of said pair of wrappers;

(b) first means for driving said first conveying means at a first constant speed;

(c) second conveying means for feeding the web onto said first conveying means;

(d) second means for driving said second conveying means at a second constant speed which is higher than said first constant speed;

(e) first cutting means positioned between said first and second conveying means for cutting the web at intervals corresponding to the length of the first wrapper of said pair, the arrangement being such that as the first cutting means operates the first wrapper is engaged by the first conveying means so that the newly cut end of the web overtakes the trailing end of the cut piece and forms an overlap therewith; and (f) second cutting means downstream of the first conveying means for cutting the web at a predetermined position behind each overlap to cut a second wrapper of said pair to thereby form a pair of overlapped wrappers, said first conveyor engaging said first wrapper only during the period between operation of said first cutter and said newly cut end of the web reaching said first conveyor.

11. Apparatus as claimed in claim 10 wherein said wrappers of each pair are of unequal length, said apparatus further comprising:

(a) third conveying means disposed downstream of said second cutting means at a distance therefrom shorter than the length of the short wrapper of said pair; and (b) third means for driving said third conveying means at a higher speed than the speed of said second conveying means which feeds the web so that said overlap is reduced accordingly.

12. Apparatus as claimed in claim 11 in which said first conveying means is adapted to intermittently propel said first wrapper.

13. Apparatus for forming pairs of overlapped wrappers, each consisting of a short wrapper and a long wrapper, for wrapping articles such as groups of cigarettes, comprising:

(a) first means for intermittently conveying the long wrapper at a first constant speed;

(b) second means for conveying said web towards said first conveying means at a higher second constant speed;

(c) first cutting means positioned between said first and second conveying means for cutting said web at intervals corresponding to the length of said long wrapper; and (d) second cutting means positioned downstream of said first conveying means for cutting said web to form each short wrapper of a pair;

(e) said first conveying means engaging and conveying said cut long wrapper only during a period between operation of said first cutting means and the arrival of a newly cut end of said web at said first conveying means, so that during said period said newly cut end overtakes and comes into overlapping relationship with the long wrapper cut by said first cutting means.

* * * * *